United States Patent [19]

Land

[11] 3,976,486

[45] Aug. 24, 1976

[54] DIFFUSION TRANSFER COLOR PRODUCTS AND PROCESSES WITH SUBSTITUTED HALIDE SILVER HALIDE EMULSIONS

[75] Inventor: Edwin H. Land, Cambridge, Mass.

[73] Assignee: Polaroid Corporation, Cambridge, Mass.

[22] Filed: July 27, 1973

[21] Appl. No.: 383,195

[52] U.S. Cl. ..... 96/3; 96/73; 96/77; 96/94 R; 96/107

[51] Int. Cl.[2] ..... G03C 7/00; G03C 1/76; G03C 1/40; G03C 1/02

[58] Field of Search ..... 96/3, 77, 94 R, 107

[56] References Cited

UNITED STATES PATENTS

| | | | |
|---|---|---|---|
| 2,592,250 | 4/1952 | Davey et al. | 96/94 R |
| 3,245,789 | 4/1966 | Rogers et al. | 96/3 |
| 3,415,644 | 12/1968 | Land | 96/3 |
| 3,561,971 | 2/1971 | Pestalozzi et al. | 96/94 R |
| 3,573,055 | 3/1971 | Allentoff et al. | 96/108 |
| 3,577,236 | 5/1971 | Fix | 96/3 |
| 3,615,579 | 10/1971 | Bigelow | 96/94 R |
| 3,622,318 | 11/1971 | Evans | 96/74 |
| 3,697,271 | 10/1972 | Timson | 96/3 |
| 3,761,276 | 9/1973 | Evans | 96/77 |
| 3,782,954 | 1/1974 | Porter et al. | 96/94 R |

OTHER PUBLICATIONS

Neblette, C. B., *Photography: Its Materials and Processes*, 1962, pp. 156 & 157, Van Nostrand Co., Inc., N.Y.

*Primary Examiner*—David Klein
*Assistant Examiner*—Richard L. Schilling
*Attorney, Agent, or Firm*—Stanley H. Mervis

[57] ABSTRACT

Multicolor diffusion transfer processes and products for use in performing such processes are disclosed employing dye developers and red-, green- and blue-sensitive silver halide emulsions, at least two of said silver halide emulsions being predominantly homogeneous substituted-halide silver halide emulsions.

45 Claims, 7 Drawing Figures

DIFFUSION TRANSFER COLOR PRODUCTS AND PROCESSES WITH SUBSTITUTED HALIDE SILVER HALIDE EMULSIONS

This invention is concerned with color photography and, more particularly, with photographic processes which provide diffusion transfer color images.

U.S. Pat. No. 2,983,606 issued May 9, 1961 to Howard G. Rogers, discloses photographic processes employing dye developers and, in particular, the formation of diffusion transfer color images by the use of dye developers. Diffusion transfer processes employing dye developers have been described in a plurality of patents.

The present invention is concerned with the use in multicolor dye developer diffusion transfer processes of certain silver halide emulsions to obtain improved sensitometry.

The primary object of the present invention is to provide novel multicolor dye developer photosensitive elements, and processes employing same, wherein at least two of the three silver halide emulsions comprise predominantly homogeneous substituted-halide silver halide emulsions.

Another object of the present invention is to provide dye developer diffusion transfer processes which produce multicolor positive transfer images exhibiting improved sensitometry and, in particular, extended dynamic range.

Other objects of this invention will in part be obvious and will in part appear hereinafter.

The invention accordingly comprises the product possessing the features, properties and the relation of components and the process involving the several steps and the relation and order of one or more of such steps with respect to each of the others which are exemplified in the following detailed disclosure, and the scope of the application of which will be indicated in the claims.

Figure 1:
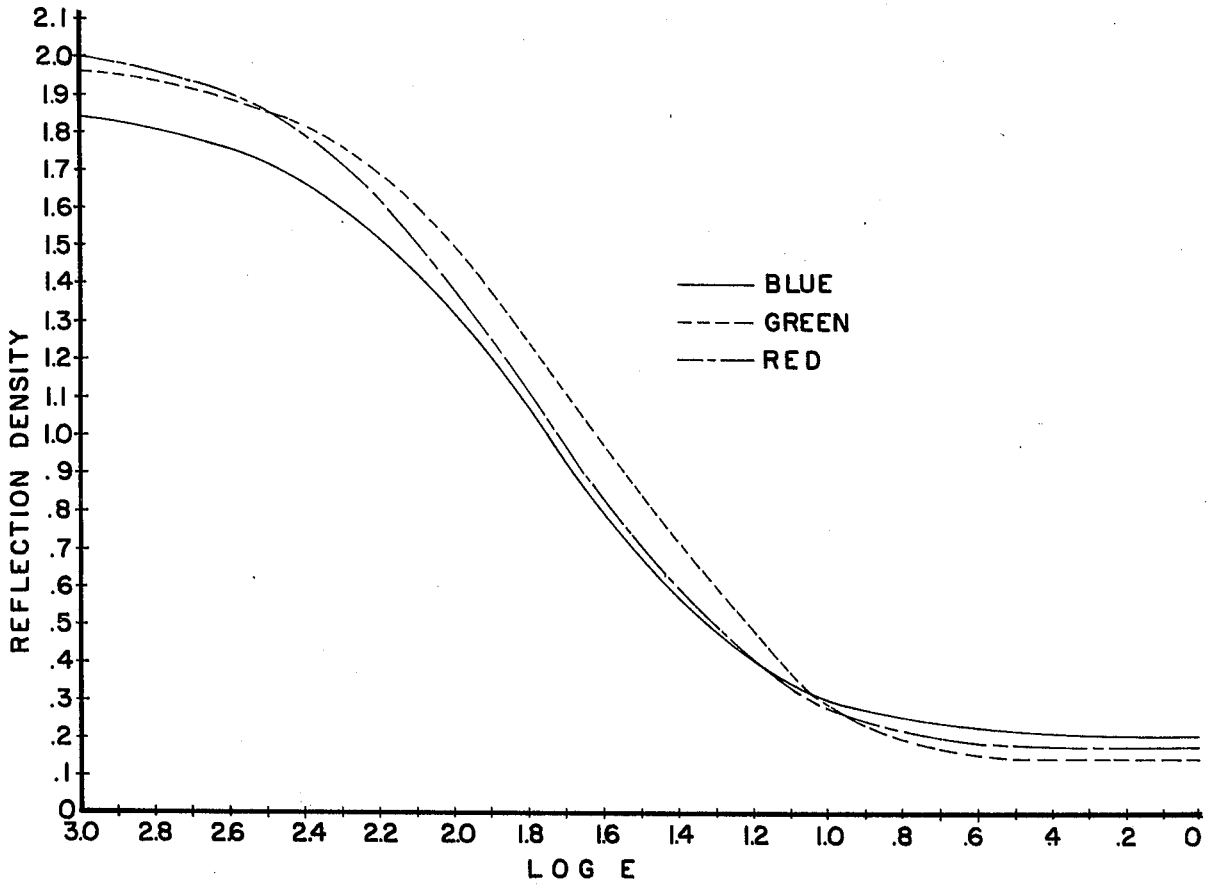
Figure 2:
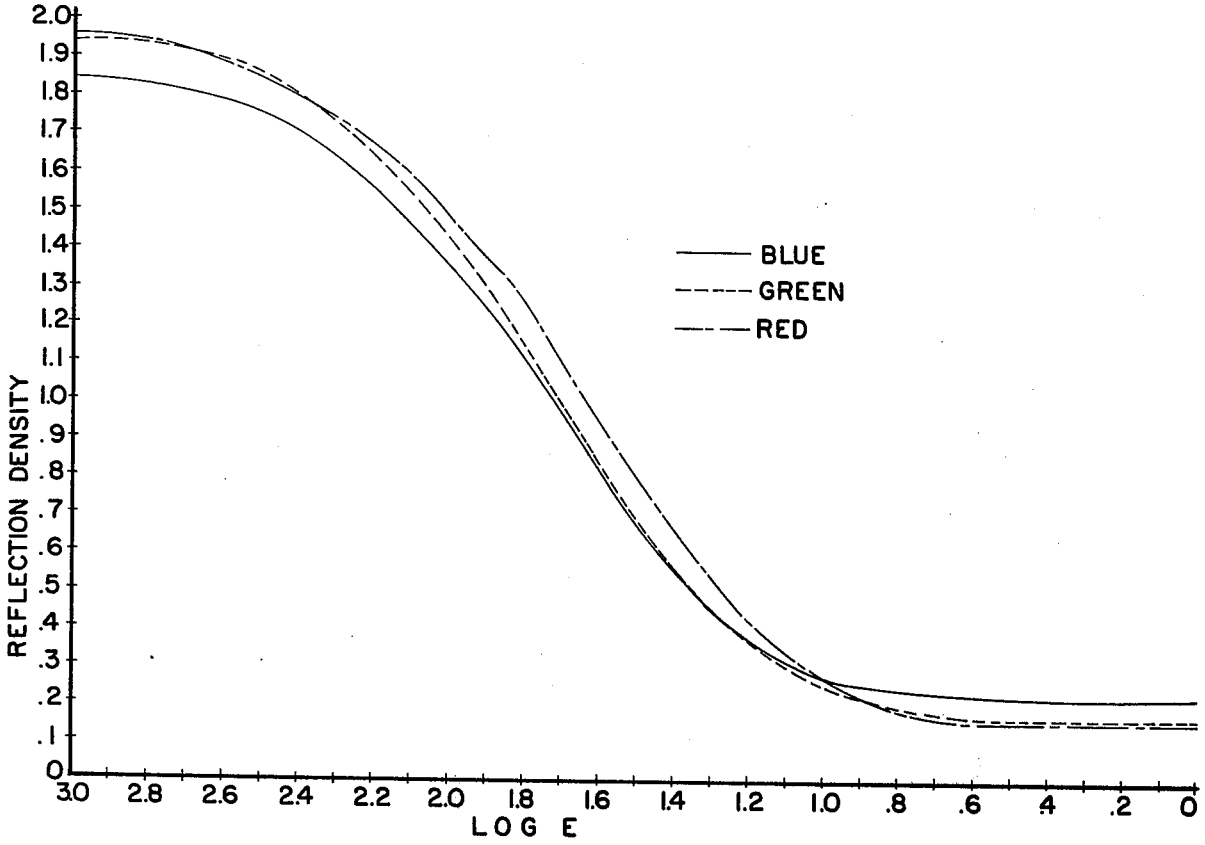
Figure 3:
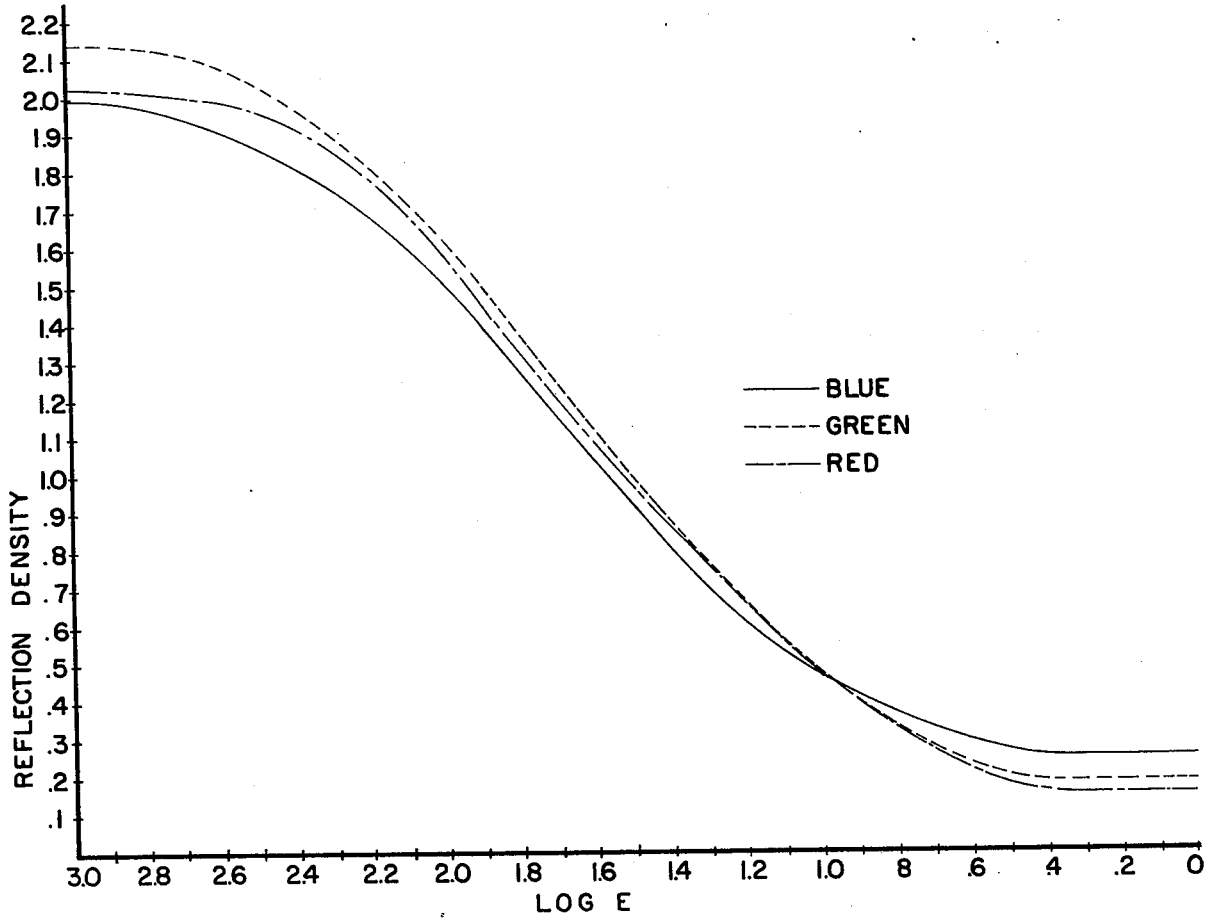
Figure 4:
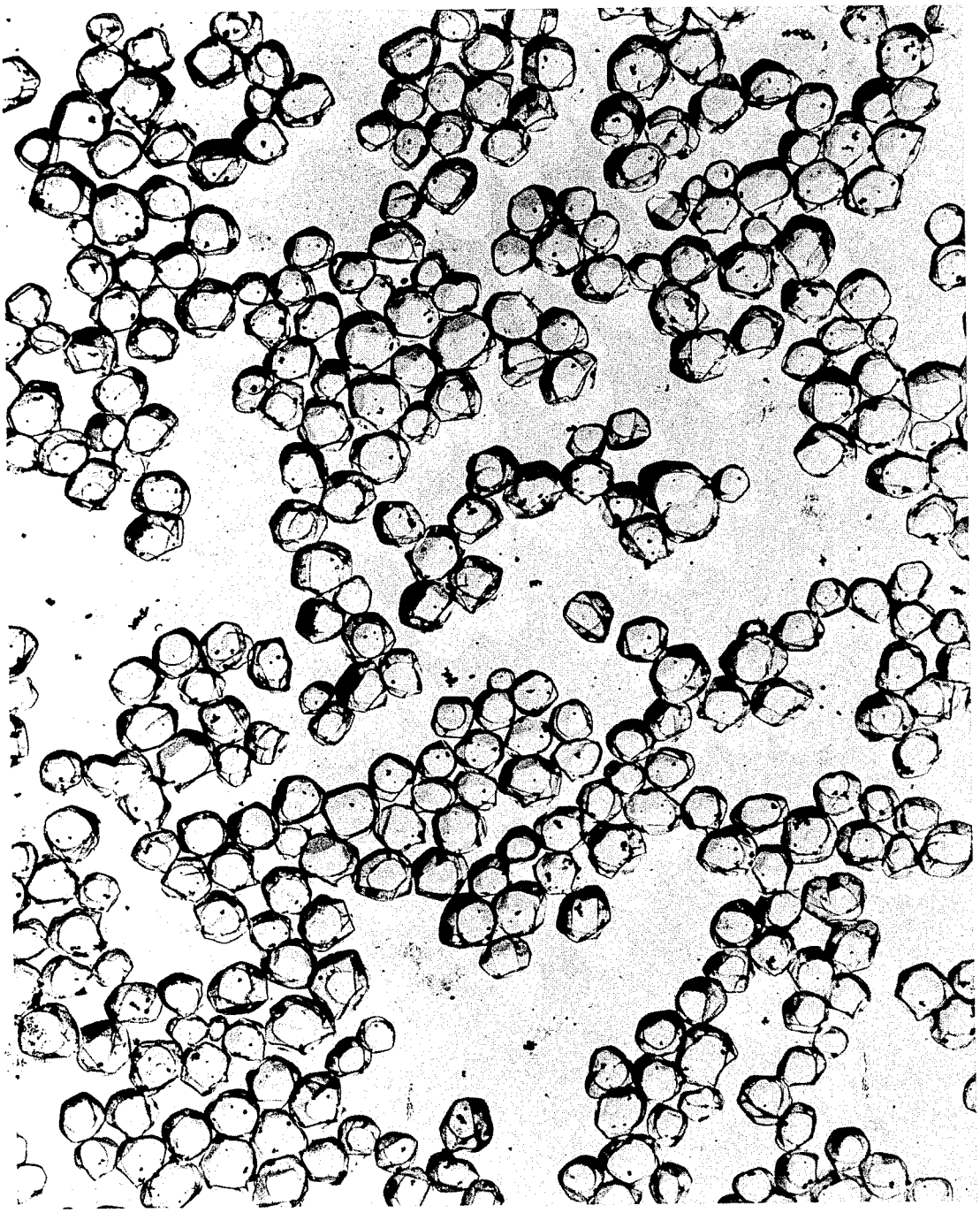
Figure 5:
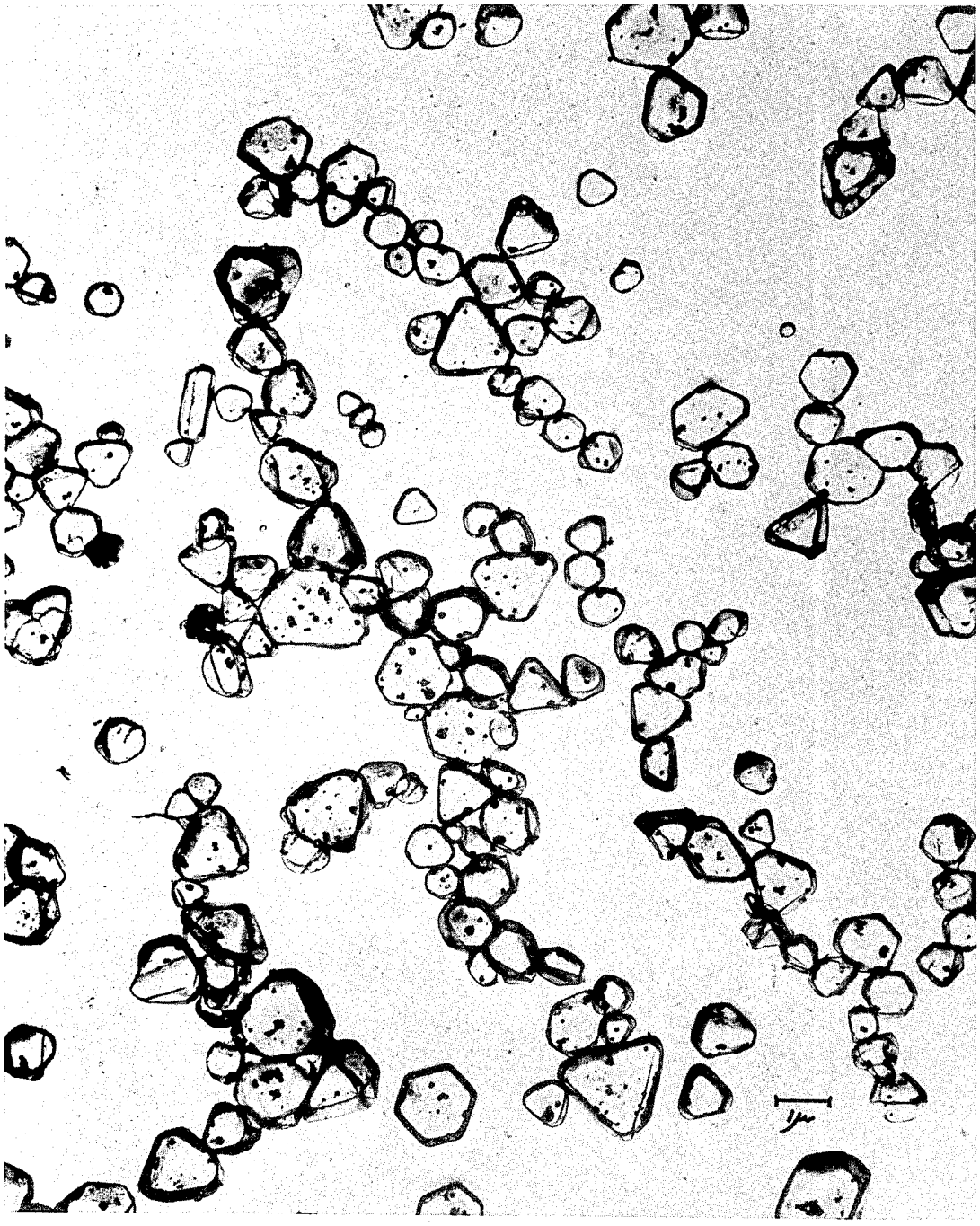
Figure 6A:
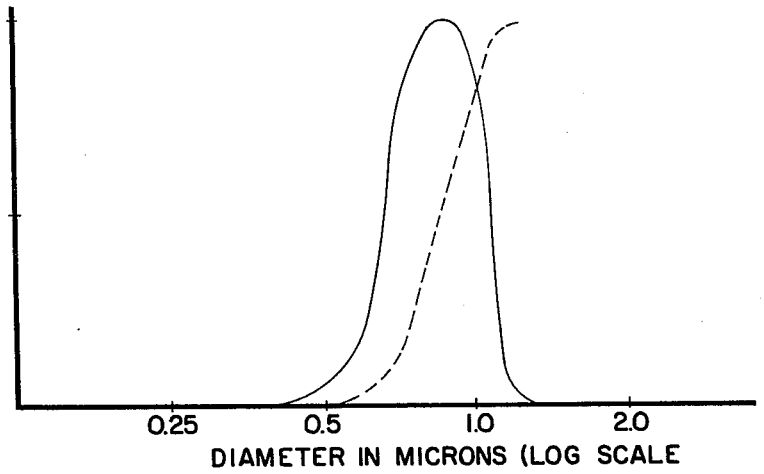
Figure 6B:
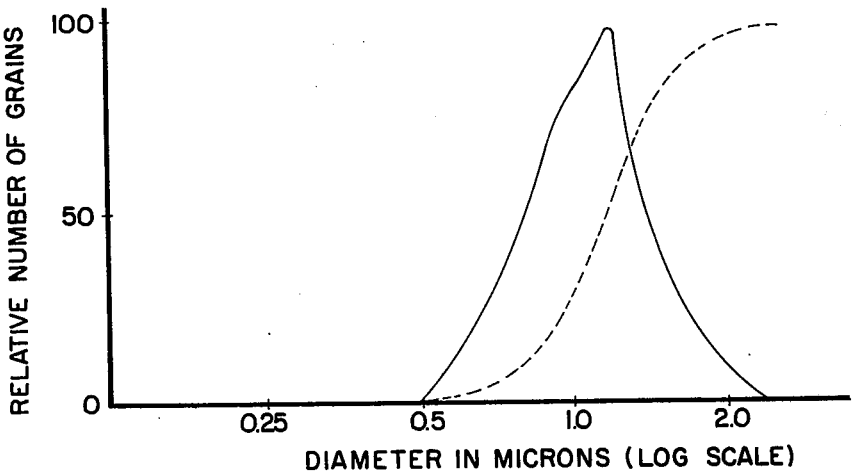

For a fuller understanding of the nature and objects of the invention, reference should be had to the following detailed description taken in conjunction with the accompanying drawings wherein:

FIG. 1 reproduces the characteristic curve of the red, green and blue densities of the neutral column of a multicolor transfer image obtained in accordance with one embodiment of the present invention;

FIG. 2 reproduces the characteristic curves of the red, green and blue densities of the neutral column of a multicolor transfer image obtained in accordance with another embodiment of the present invention;

FIG. 3 reproduces the characteristic curve of the red, green and blue densities of the neutral column of a multicolor transfer image obtained in accordance with another embodiment of the present invention;

FIG. 4 reproduces an electron micrograph at 10,000x magnification of replicas of undeveloped silver iodochlorobromide grains of a substituted-halide silver halide emulsion utilized in accordance with the present invention;

FIG. 5 reproduces an electron micrograph at 10,000x magnification of replicas of undeveloped silver iodobromide grains of an emulsion representative of the prior art; and FIGS. 6*a* and 6*b* reproduce graphs of the grain size-frequency distribution of predominantly homogeneous substituted-halide silver halide emulsions useful in the practice of the present invention.

This invention is particularly directed to photographic processes wherein the desired image is obtained by processing an exposed photosensitive silver halide material with a processing composition distributed between two sheet-like elements, one of said elements including said photosensitive material. The processing composition is so applied and confined within and between the two sheet-like elements as not to contact or wet outer surfaces of the superposed elements, thus providing a film unit or film packet whose external surfaces are dry. The processing composition may be viscous or nonviscous, and preferably is distributed from a single-use rupturable container; such pressure rupturable processing containers are frequently referred to as "pods". The final image is a multicolor image.

As noted above, U.S. Pat. No. 2,983,606 describes diffusion transfer color processes employing dye developers, i.e., a compound which is both a silver halide developing agent and a dye. A photosensitive element containing a dye developer and a silver halide emulsion may be exposed and wetted by a liquid processing composition, for example, by immersion, coating, spraying, flowing, etc., in the dark, and the exposed photosensitive element superposed prior to, during, or after wetting, on a sheetlike support element which may be utilized as an image-receiving element. In a preferred embodiment, the liquid processing composition is applied to the photosensitive element in a substantially uniform layer as the photosensitive element is brought into superposed relationship with the image-receiving layer. The liquid processing composition, positioned intermediate the photosensitive element and the image-receiving layer in a preferred embodiment, permeates the emulsion to initiate development of the latent image contained therein. The dye developer is immobilized or precipitated in exposed areas as a consequence of the development of the latent image. This immobilization is apparently, at least in part, due to a change in the solubility characteristics of the dye developer upon oxidation and especially as regards its solubility in alkaline solutions. It may also be due in part to a tanning effect on the emulsion by oxidized developing agent, and in part to a localized exhaustion of alkali as a result of development. In unexposed and partially exposed areas of the emulsion, the unreacted dye developer is diffusible and there is thus provided an imagewise distribution of unoxidized dye developer, diffusible in the liquid processing composition, as a function of the point-to-point degree of exposure of the silver halide emulsion. At least part of this imagewise distribution of unoxidized dye developer is transferred, by imbibition, to a superposed image-receiving layer or element. The image-receiving layer receives a depthwise diffusion, from the developed emulsion, of unoxidized dye developer without appreciably disturbing the imagewise distribution thereof to provide a reversed or positive color image of the developed image. The image-receiving element may contain agents adapted to mordant or otherwise fix the diffused, unoxidized dye developer. If the color of the transferred dye developer is affected by changes in the pH of the image-receiving element, this pH may be adjusted in accordance with well-known techniques to provide a pH affording the desired color. In the preferred embodiments of said U.S. Pat. No. 2,983,606 and in the commercial applications thereof, the desired positive image is revealed by separating the image-receiving layer from the photosensitive element at the end of a suitable imbibition period. Alternatively, as also disclosed in said U.S. Pat. No. 2,983,606, the image-receiving layer need not be separated from its superposed contact with the photosensitive element, subsequent to transfer image formation, if the support for the image-receiving layer, as well as any other layers intermediate said support and image-receiving layer, is transparent and a processing composition containing a substance, e.g., a white pigment, effective to mask the developed silver halide emulsion or emulsions is applied between the image-receiving layer and said silver halide emulsion or emulsions.

Dye developers, as noted above, are compounds which contain, in the same molecule, both the chromophoric system of a dye and also a silver halide developing function. By "a silver halide developing function" is meant a grouping adapted to develop exposed silver halide. A preferred silver halide development function is a hydroquinonyl group. Other suitable developing functions include ortho-dihydroxyphenyl and ortho- and para-amino substituted hydroxyphenyl groups. In general, the development function includes a benzenoid developing function, that is, an aromatic developing group which forms quinonoid or quinone substances when oxidized.

Multicolor images may be obtained using dye developers in diffusion transfer processes by several techniques. One such technique contemplates obtaining multicolor transfer images utilizing dye developers by employment of an integral multilayer photosensitive element, such as is disclosed in the aforementioned U.S. Pat. No. 2,983,606, and particularly with reference to FIG. 9 of said patent, and also in U.S. Pat. No. 3,345,163 issued Oct. 3, 1967 to Edwin H. Land and Howard G. Rogers, wherein at least two selectively sensitized photosensitive strata, superposed on a single support in a "tripack" structure, are processed simultaneously and without separation, with a single common image-receiving layer. A suitable arrangement of this type comprises a support carrying a red-sensitive silver halide emulsion stratum, a green-sensitive silver halide emulsion stratum and a blue-sensitive silver halide emulsion stratum, said emulsions having associated therewith, respectively, a cyan dye developer, a magenta dye developer and a yellow dye developer. The dye developer may be utilized in the silver halide emulsion stratum, for example in the form of particles, or it may be disposed in a stratum behind the appropriate silver halide emulsion strata. Each set of silver halide emulsion and associated dye developer strata may be separated from other sets by suitable interlayers, for example, by a layer or stratum of gelatin or other polymeric material as is known in the art. In certain instances, it may be desirable to incorporate a yellow filter in front of the green-sensitive emulsion and such yellow filter may be incorporated in an interlayer. However, where desirable, a yellow dye developer of the appropriate spectral characteristics and present in a state capable of functioning as a yellow filter may be so employed and a separate yellow filter omitted.

The dye developers are preferably selected for their ability to provide colors that are useful in carrying out subtractive color photography, that is, the previously mentioned cyan, magenta and yellow. The dye developers employed may be incorporated in the respective silver halide emulsion or, in the preferred embodiment, in a separate layer behind the respective silver halide emulsion. Specifically, the dye developer may, for example, be in a coating or layer behind the respective silver halide emulsion and such a layer of dye developer may be applied by use of a coating solution containing the respective dye developer distributed, in a concentration calculated to give the desired coverage of dye developer per unit area, in a film-forming natural, or synthetic, polymer, for example, gelatin, polyvinyl alcohol, and the like, adapted to be permeated by the processing composition.

As is now well known and illustrated, for example, in the previously cited patents, the processing composition referred to for effecting multicolor diffusion transfer processes comprises at least an aqueous solution of an alkaline material, for example, sodium hydroxide, potassium hydroxide, and the like, and preferably possesses a pH in excess of 12, and most preferably includes a viscosity-increasing compound constituting a film-forming material of the type which, when the composition is spread and dried, forms a relatively firm and relatively stable film. The preferred film-forming materials comprise high molecular weight polymers such as polymeric, water-soluble ethers which are inert to an alkaline solution such as, for example, a hydroxyethyl cellulose or sodium carboxymethyl cellulose. Additional film-forming materials or thickening agents whose ability to increase visocity is substantially unaffected if left in solution for a long period of time are also known in the art and may be utilized. As stated, the film-forming material is preferably contained in the processing composition in such suitable quantities as to impart to the composition a viscosity in excess of 100 cps. at a temperature of approximately 24° C. and preferably in the order of 100,000 cps. to 200,000 cps. at that temperature.

U.S. Pat. Nos. 3,415,644, 3,415,645 and 3,415,646, all issued Dec. 10, 1968 in the name of Edwin H. Land, disclose and claim photographic products and processes wherein a photosensitive element and an image-receiving element are maintained in fixed relationship prior to exposure, and this relationship is maintained as a laminate after processing and image formation. In these processes, the final image is viewed through a transparent (support) element against a reflecting, i.e., white background. In a particularly useful embodiment, photoexposure is made through said transparent element and application of the processing composition provides a layer of light-reflecting material to provide a white background. The light-reflecting material (referred to in said patents as an "opacifying agent") is preferably titanium dioxide, and it also performs an opacifying function, i.e., it is effective to mask the developed silver halide emulsions so that the transfer image may be viewed without interference therefrom, and it also acts to protect the photoexposed silver halide emulsions from post-exposure fogging by light passing through said transparent layer if the photoexposed film unit is removed from the camera before image-formation is completed.

U.S. Pat. No. 3,647,437 issued to Edwin H. Land on Mar. 7, 1972 is concerned with improvements in the above-mentioned processes, and discloses the provision of light-absorbing materials to permit such processes to be performed outside of the camera in which photoexposure is effected and under much more intense ambient light conditions. A light-absorbing material or reagent, preferably a dye, is provided so positioned and/or constituted as not to interfere with photoexposure but so positioned between the photoexposed silver halide emulsions and the transparent support during processing after photoexposure as to absorb light which otherwise might fog the photoexposed emulsions. Furthermore, the light-absorbing material is so positioned and/or constituted after processing as not to interfere with viewing the desired image shortly after said image has been formed. In the preferred embodiments, the light-absorbing material, also sometimes referred to herein as an optical filter agent, is initially contained in the processing composition together with a light-reflecting material, e.g., titanium dioxide. The concentration of the light-absorbing dye is selected to provide the light transmission opacity required to perform the particular process under the selected light conditions.

In a particularly useful embodiment, the light-absorbing dye is highly colored at the pH of the processing composition, e.g., 13–14, but is substantially non-absorbing of visible light at a lower pH, e.g., less than 10–12. This pH reduction may be effected by an acid-reacting reagent appropriately positioned in the film unit, e.g., in a layer between the transparent support and the image-receiving layer.

For convenience, the disclosure of the above cited patents is hereby specifically incorporated herein.

it has now been found that such dye developer multicolor transfer processes may be improved by utilizing as the silver halide emulsion in at least two of the three color-forming units, a predominantly homogeneous substituted-halide silver halide emulsion, the grains of which have a grain size distribution range and mean diameter set forth hereinafter in more detail. The silver halide emulsions preferably are coated as a "single grain layer" or "monolayer" of silver halide grains, i.e., the silver halide emulsion is substantially free of overlapping silver halide grains, although the silver halide emulsion layer itself may be thicker than the silver halide grains. The silver halide grains in the coated layer advantageously are relatively uniformly distributed.

The term "substituted-halide silver halide grains" is used herein to refer to silver halide grains prepared by replacing or "substituting" a portion of the chloride anions of silver chloride or silver iodochloride grains with bromide and/or iodide anions in an exchange reaction which may be described as a "simple metathesis" exchange reaction. Suitable procedures for preparing substituted-halide silver halide emulsions useful in the present invention are set forth in the copending applications of Vivian K. Walworth, Ser. NO. 383,176 and Ser. No. 383,177, both filed concurrently herewith; said applications are hereby incorporated herein by reference.

Individual silver halide grains have, of course, finite dimensions and one frequently describes silver halide emulsions, inter alia, in terms of the "mean diameter" of the silver halide grains thereof. The silver halide grains of the silver halide emulsions used in this invention are "regular" in crystal habit, i.e., they are generally polyhedra of three-fold symmetry, such as spheres, cubes, octahedra, and nearly spherical, rounded-off octahedra such as plates or platelets. "Three-fold symmetry" is used here to mean symmetry about three mutually perpendicular axes.

The substituted-halide silver halide emulsions employed in the practice of the present invention have a mean diameter within the range of about 0.7 to 1.5 microns, and preferably within the range of about 0.9 to 1.4 microns. In the most useful embodiments, at least 80% of the silver halide grains have a diameter within about ± 40% of the mean diameter. Indeed, the grain size distribution may advantageously be such that at least 90% of the silver halide grains have a diameter within about ± 40%, and in certain instances within about ± 30% of the mean diameter.

The substituted-halide silver halide emulsions used in this invention have been described as being predominantly homogeneous in grain size, and preferable grain size distributions have been noted. It should be understood, however, that the substituted1halide silver halide emulsions must not only be predominantly homogeneous in grain size distribution, but the emulsion must also be one whose characteristic curve or photographic response is substantially independent of grain size distribution. In emulsions of wide grain size distribution, the characteristic curve is the result of the individual responses of a plurality of grain size families. Indeed, when one separates a particular grain size family of grains, the resulting silver halide emulsion is frequently high contrast emulsion. The present invention, however, utilizes substituted-halide silver halide emulsions which are predominantly homogeneous in grain size (and therefore have similar solubility characteristics) and have a photographic response substantially independent of grain size. This latter characteristic may be considered to contemplate a mixture of silver halide grains of about the same diameter but which vary in their sensitivity, i.e., in their response in the diffusion transfer process.

Techniques for removing silver halide grains below and/or above a predetermined size or size range from a silver halide emulsion, e.g., by centrifugal separation, are known in the art and may be utilized in obtaining silver halide emulsions which are predominantly homogeneous in grain size. Silver halide emulsions of the type contemplated for use in the present invention may also be prepared by blending several silver halide emulsions or emulsion fractions each having substantially the same grain size but sensitized to different levels or "speeds".

The substituted-halide silver halide emulsions employed in the present invention are preferably silver iodochlorobromide emulsions. In general, the silver halide will contain about 1 to 50 mole percent chloride (preferably about 10 to 50 mole percent chloride), and 0 to about 10 mole percent iodide (preferably at least 1 mole percent iodide), the remaining halide being bromide.

The substituted-halide silver halide emulsions employed in the practice of this invention may be prepared by forming grains of silver chloride or silver iodochloride and replacing a portion of the chloride anions with bromide and/or iodide anions. All of the chloride is not replaced, and in partocularly useful embodiments the substituted-halide silver halide emulsion is a silver iodochlorobromide emulsion in which at least part of the iodide is contained in the core of the grains. In the emulsion preparation, the halides are conveniently introduced in the form of the alkali metal salts. Following formation of the silver chloride or silver iodochloride grains, bromide and/or iodide salts may be added together, or separately in either order, to effect the desired substitution for chloride. Double jet addition techniques for simultaneously introducing silver and halide ions are especially adapted for controlling the grain size distribution within desired limits.

The following example of the preparation of a substituted-halide silver halide emulsion by initially forming silver chloride grains is reproduced from the aforementioned concurrently filed application of Vivian K. Walworth, Ser. No. 383,176, for purposes of illustration. (Halide content was determined by X-ray fluorescence analysis.)

EXAMPLE 1

A solution of gelatin and potassium chloride (Solution A) was prepared by dissolving 205 g. of phthalic anhydride derivatized inert bone gelatin and 205 g. of potassium chloride in 5,750 ml. of distilled water. A solution of potassium chloride (Solution B) was prepared by dissolving 1,026 g. of potassium chloride in 5,336 ml. of distilled water. A silver nitrate solution (Solution C) was prepared by dissolving 2,000 g. of silver nitrate in 5,336 ml. of water. Solution A was heated to 80° C. and Solutions B and C were heated to 70° C. Solutions B and C were then added to Solution A simultaneously (by double jet addition) over a period of 8 minutes. The resulting mixture was digested 5 minutes at 80° C. After this digestion period, a solution of 1,337 g. of potassium bromide and 60 g. of potassium iodide dissolved in 5,336 ml. of water and heated to 70° C. was added over a period of 8 minutes keeping the temperature at 80° C. The mixture was then digested for 35 minutes at 80° C. After the digestion period, the mixture was cooled to 20° C. and the pH adjusted to about 2.7 with 10% sulfuric acid. The silver halide-gelatin flocculate was washed several times with chilled, distilled water until the conductivity of the supernatant liquid reached 50–100 $\mu$mhos. After the last decantation of excess wash water, 950 g. of dry active bone gelatin was added and allowed to swell for 20 minutes. The temperature was then raised to 38° C. and held there for 20 minutes while the gelatin dissolved. After adjusting the pH to about 5.7, the temperature was raised to 54° C. and 24 ml. of a solution of an ammonium gold thiocyanate complex was added. (This chemical sensitizer solution was prepared by mixing a solution of 1.0 g. of ammonium thiocyanate in 99 ml. of water with 12 ml. of a solution containing 0.97 g. of gold chloride in 99 ml. of water.) The emulsion was then after ripened at 54° C. for 120 minutes. The emulsion was cooled to 38° C., optical sensitizer added and the emulsion digester for about 45 minutes before being chilled and set. The resultant silver iodochlorobromide emulsion contained approximately 85 mole percent bromide, 12 mole percent chloride and 3 mole percent iodide, as determined by X-ray fluorescence analysis. The silver iodochlorobromide grains had a mean diameter of about 0.86 micron, and 90% of the grains had a diameter within the range of about 0.63 to 1.08 micron, or within ± 26% of the mean diameter.

Further graphic visual evidence of the homogeneous grain size distribution of the silver iodochlorobromide emulsion prepared in Example 1 may be obtained by examination of the electron migrograph (10,000x) reproduced in FIG. 4, of these grains replicated in carbon-platinum. The silver halide grains of this emulsion are far more homogeneous in grain size than silver halide emulsions used in commercially available diffusion transfer processes. This fact is readily apparent from a visual comparison of FIG. 4 with FIG. 5 which reproduces an electron micrograph (10,000x) of similar carbon-platinum replicas of a silver iodobromide (2 mole percent iodide) emulsion of the type used in Polaroid SX-70 Land film.

Grain size distribution curves, or grain size-frequency distribution curves as they are sometimes called, are frequently used to describe and define silver halide emulsions. Mees and James, *The Theory of the Photographic Process*, 3rd Edition, The Macmillan Company, New York, N. Y., 1966, pages 36–44, set forth a description of techniques of measuring the size of silver halide grains and of determining the frequency of grains of given sizes in a particular silver halide emulsion. Electron microscope size-frequency analysis of silver halide emulsions gives measurements particularly useful with grains too small to resolve well by light microscopy.

FIG. 6*a* reproduces the grain size-frequency distribution curve of particle sizes (1,000 grains) determined using a Zeiss TGZ-3 particle size analyzer to obtain counts from electron micrographs of the silver halide emulsion prepared in Example 1. The horizontal axis for the curve in FIG. 8*a* represents relative log diameter in microns of the silver halide grains, while the vertical axis represents the relative number of grains, with the dotted curve representing cumulative percentile. For the silver halide emulsion prepared in Example 1, the mean particle diameter was 0.86 micron. While the percent deviation from the mean diameter of 90% of the silver halide grains has been stated in Example 1, visual comparison of the grain size-frequency distribution curve reproduced in FIG. 6*a* graphically demonstrate far more clearly the narrow distribution, i.e., the homogeneous grain size, of the substituted-halide emulsion prepared in Example 1.

It is also possible to characterize the grain size distribution of a silver halide emulsion by use of the dispersion number of the grain size-frequency distribution curve, i.e., the number obtained as follows: the grain size diameter of the 16th percentile is substracted from the grain size diameter at the 84th percentile, and the resulting number is divided by the median diameter. The smaller the dispersion number, the narrower will be the band width of the grain size-frequency distribution curve. The dispersion number for the silver halide emulsion prepared in Example 1 (see FIG. 6*a*) was 0.35. The silver halide emulsions useful in practicing the present invention have a dispersion number of 0.70 or less, preferably 0.55 or less.

The following example of a method of preparing such a substituted-halide silver halide emulsion by initially preparing silver iodochloride grains is reproduced from the aforementioned concurrently filed application of Vivian K. Walworth, Ser. No. 383,177, for purposes of illustration. (Halide content was determined by X-ray fluorescence analysis.)

As noted above, in a particularly useful embodiment, the core of the substituted-halide silver halide grains contains iodide.

EXAMPLE 2

A solution of gelatin and potassium chloride (Solution A) was prepared by dissolving 546 g. of phthalic anhydride derivatized inert bone gelatin and 546 g. of potassium chloride in 10,807 ml. of distilled water. A solution of potassium chloride and potassium iodide (Solution B) was prepared by dissolving 2,736 g. of potassium chloride and 180 g. of potassium iodide in 14,230 ml. of distilled water. A silver nitrate solution (Solution C) was prepared by dissolving 5,334 g. of silver nitrate in 14,230 ml. of water. Solution A was heated to 80° C. and Solutions B and C were heated to 70° C. Solutions B and C were then added to Solution A by double jet addition at a rate of about 830 ml. per minute over about 18 minutes. The resulting mixture was digested 5 minutes at 80° C. After this digestion period, a solution of 2,932 g. of potassium bromide dissolved in 14,230 ml. of water and heated to 70° C. was added at a rate of about 780 ml. per minute over about 20 minutes, keeping the temperature at 80° C. The mixture was then digested for 35 minutes at 80° C. After the digestion period, the mixture was cooled to 20° C. and the pH adjusted to about 2.7 with 10% sulfuric acid. The precipitate of gelatin and silver halide was washed several times with chilled, distilled water until the supernatant liquid reached a conductivity of 50–100 μmhos. After the last decantation of excess wash water, 2,534 g. of dry active bone gelatin was added and allowed to swell for 20 minutes. The temperature was then raised to 38° C. and held there for 20 minutes while the gelatin dissolved. The pH was adjusted to 5.7 with 10% sodium hydroxide, and the pAg was adjusted to 9.0 with 2.0 N potassium chloride. The temperature was raised to 54° C. and 64 ml. of a solution of an ammonium gold thiocyanate complex was added. (This chemical sensitizer solution was prepared by mixing a solution of 1.0 g. of ammonium thiocyanate in 99 ml. of water with 12 ml. of a solution containing 0.97 g. of gold chloride in 99 ml. of water.) The emulsion was then afterripened at 54° C. for 90 minutes. 34.6 ml. of a 10% slightly alkaline solution of 4-hydroxy-6-methyl-1,3,3*a*,7-tetrazaindene was then added. The emulsion was cooled to 38° C., optical sensitizer added and the emulsion digested for about 10 minutes before being chilled and set. The resultant silver iodochlorobromide emulsion contained approximately 79 mole percent bromide, 18 mole percent chloride and 3 mole percent iodide. The silver iodochlorobromide grains had a mean diameter of about 1.2 micron, and 80% of the grains had a diameter within the range of about 0.8 to 1.6 microns, or within ± 33% of the mean diameter. 90% of the silver halide grains had a diameter within the range of 0.72 to 1.77 microns, or within −40% and +48% of the mean diameter. The grain size-frequency distribution curve for this emulsion is reproduced in FIG. **6*b*** and had a dispersion number of 0.55.

In particularly useful multicolor diffusion transfer systems, multicolor transfer images are obtained by exposing a photosensitive element, sometimes referred to as a "negative component", comprising a plurality of light-sensitive silver halide emulsions, each having a dye developer of appropriate color associated therewith in the same or in an adjacent layer; developing this exposed element with a processing composition to form imagewise distributions of each diffusible dye developer as a function of development; and transferring these imagewise distributions, at least in part, by diffusion, to a superposed image-receiving layer, sometimes referred to as a "positive component", comprising at least a dyeable stratum to provide the multicolor transfer image. The negative and positive components initially may be carried on separate supports which are brought together during processing and thereafter separated, or they may be retained together as an integral negative-positive reflection print. Alternatively, they may initially comprise a unitary structure, e.g., integral negative-positive film units wherein the negative and positive components are part of a photosensitive laminate or they may otherwise be physically retained together in superposed relationship prior to, during and after image formation. (Procedures for forming such film units wherein the positive and negative components are temporarily laminated together prior to exposure are described, for example, in U.S. Pat. No. 3,652,281 to Albert J. Bachelder and Frederick J. Binda and in U.S. Pat. No. 3,652,282 to Edwin H. Land, both issued Mar. 28, 1972.) IN such instances, the positive component is not removed from the negative component for viewing purposes. Such film units further include means for providing a reflecting layer between the dyeable stratum and the negative component in order to mask effectively the silver images formed as a function of development of the silver halide layers and also to mask image dye developers which are not transferred, thereby providing a background, preferably white, for viewing the color image formed in the dyeable stratum, without separation, by reflected light. This reflecting layer may comprise a preformed layer of a reflecting agent included in the film unit or the reflecting agent may be provided after photoexposure, e.g., by including the reflecting agent in the processing composition. The dye transfer image is then viewable through a dimensionally stable protective layer or support. Most preferably another dimensionally stable layer or support, which may be transparent or opaque, is positioned on the opposed surface of the layers so that the aforementioned layers are between a pair of dimensionally stable layers or support members, one of which is transparent to permit viewing therethrough of the color transfer image. A rupturable container of known description contains the requisite processing composition and is adapted upon application of pressure to release its contents for development of the exposed film unit, e.g., by distributing the processing composition in a substantially uniform layer between a pair of predetermined layers. In film units of the preferred embodiment, a processing composition containing a white pigment is distributed between the dyeable stratum and the negative component to provide the light-reflecting layer.

In lieu of having the light-reflecting pigment in the processing composition, the light-reflecting pigment used to mask the photosensitive strata and to provide the requisite background for viewing the color transfer image formed in the receiving layer may be present initially in whole or in part as a preformed layer in the film unit. As an example of such a preformed layer, mention may be made of that disclosed in U.S. Pat. No. 3,615,421 issued Oct. 26, 1971 and in U.S. Pat. No. 3,620,724 issued Nov. 16, 1971, both in the name of Edwin H. Land. The reflecting agent may be generated in situ as is disclosed in U.S. Pat. Nos. 3,647,434 and 3,647,435, both issued Mar. 7, 1972 to Edwin H. Land.

The image-receiving layer may comprise one of the materials known in the art, such as polyvinyl alcohol, gelatin, etc. It may contain agents adapted to mordant or otherwise fix the transferred image dye(s). Preferred materials comprise polyvinyl alcohol or gelatin containing a dye mordant such as poly-4-vinylpyridine, as disclosed in U.S. Pat. No. 3,148,061, issued Sept. 8, 1964 to Howard C. Haas. If the color of the transferred image dye(s) is affected by changes in pH, the pH of the image layer may be adjusted to provide a pH affording the desired color.

In the various color diffusion transfer systems which have previously been described and which employ an aqueous alkaline processing fluid, it is well known to employ an acid-reacting reagent in a layer of the film unit to lower the environmental pH following substantial dye transfer in order to increase the image stability and/or to adjust the pH from the first pH at which the image dyes are diffusible to a second (lower) pH at which they are not. For example, the previously mentioned U.S. Pat. No. 3,415,644 discloses systems wherein the desired pH reduction may be effected by providing a polymeric acid layer adjacent the dyeable stratum. These polymeric acids may be polymers which contain acid groups, e.g., carboxylic acid and sulfonic acid groups, which are capable of forming salts with alkali metals or with organic bases; or potentially acid-yielding groups such as anhydrides or lactones. Preferably the acid polymer contains free carboxyl groups. Alternatively, the acid-reacting reagent may be in a layer adjacent the silver halide most distant from the image-receiving layer, as disclosed in U.S. Pat. No. 3,573,043 issued Mar. 30, 1971 to Edwin H. Land. Another system for providing an acid-reacting reagent is disclosed in U.S. Pat. No. 3,576,625 issued Apr. 27, 1971 to Edwin H. Land.

An inert interlayer or spacer layer may be and is preferably disposed between the polymeric acid layer and the dyeable stratum in order to control or "time" the pH reduction so that it is not premature and interfere with the development process. Suitable spacer or "timing" layers for this purpose are described with particularity in U.S. Pat. Nos. 3,362,819; 3,419,389; 3,421,893; 3,455,686; and 3,575,701.

While the acid layer and associated spacer layer are preferably contained in the positive component employed in systems wherein the dyeable stratum and photosensitive strata are contained on separate supports, e.g., between the support for the receiving element and the dyeable stratum; or associated with the dyeable stratum in those integral film units, e.g., on the side of the dyeable stratum opposed from the negative components, if desired they may be alternatively or additionally associated with the photosensitive strata, as is disclosed, for example, in U.S. Pat. Nos. 3,362,821 and 3,573,043. In film units such as those described in the aforementioned U.S. Pat. Nos. 3,594,,164 and 3,594,165, they also may be contained on the spreader sheet employed to facilitate application of the processing fluid.

In a preferred embodiment of this invention, a negative component comprises an opaque film support carrying, in order, a layer of a cyan dye developer, a layer of a red-sensitive silver halide emulsion, an interlayer, a layer of a magenta dye developer, a layer of a green-sensitive silver halide emulsion, an interlayer, a layer of a yellow dye developer, and a layer of a blue-sensitive silver halide emulsion. A positive component comprises a second support (transparent) carrying, in order, a polymeric acid layer, a spacer or timing layer, and an image-receiving layer. Following photoexposure through the transparent support and the layers carried thereon, a container is ruptured and the processing composition contained therein is distributed between the opposing surfaces of the superposed positive and negative components. The processing composition includes a light-reflecting material, e.g., titanium dioxide, and a light-reflecting layer is thereby provided between the image-receiving layer and the blue-sensitive silver halide emulsion layer. After a suitable period, the polymeric acid layer is permeated by alkali and the pH is reduced to a predetermined level. In the preferred embodiment for practicing the process outside of a camera, the processing composition includes appropriate pH-sensitive dye(s) to provide opacification during processing, and the final pH is one below the pKa of the pH-sensitive dye(s), thereby discharging their color. The final multicolor transfer image in the image-receiving layer is viewed through the transparent support against a white background provided by the titanium dioxide. Suitable binder tape may be provided to secure the various layers in fixed relationship prior to, during and after photo-exposure and processing. Such film units may be ejected out of a camera into ambient light.

The following examples of the formation of multicolor transfer images utilizing predominantly homogeneous substituted-halide silver halide emulsions in accordance with this invention are set forth for purposes of illustration and are not intended to be limiting.

EXAMPLE 3

A multicolor photosensitive element of the type described in the above-mentioned U.S. Pat. No. 3,647,437 using, as the cyan, magenta and yellow dye developers cyan:

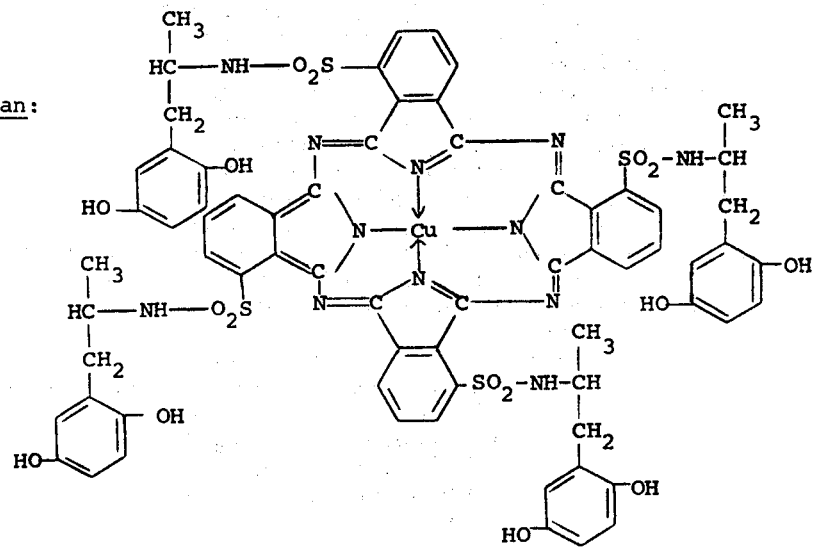

magenta:

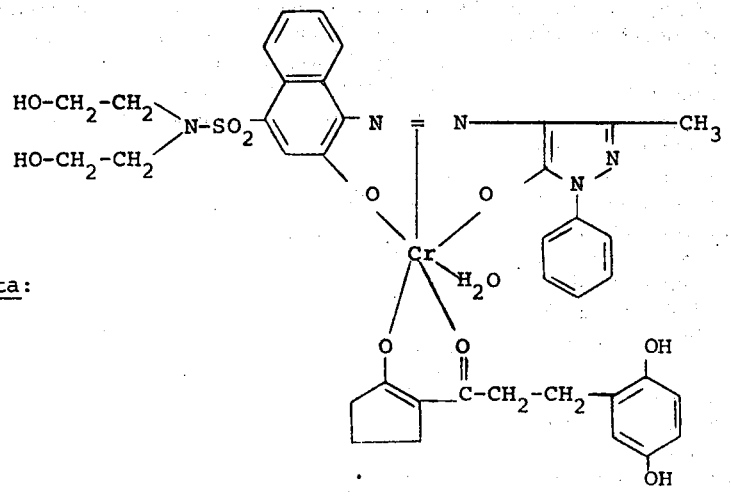

yellow:

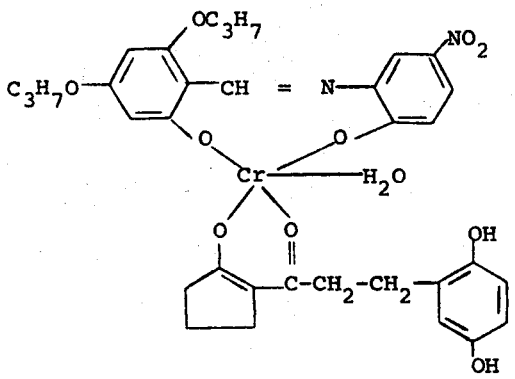

was prepared by coating a gelatin-subcoated 4 mil opaque polyethylene terephthalate film base with the following layers:

1. a layer of cyan dye developer dispersed in gelatin and coated at a coverage of about 53 mgs./ft.$^2$ of dye and about 96 mgs./ft.$^2$ of gelatin;

2. a red-sensitive gelatino silver iodochlorobromide emulsion coated at a coverage of about 90 mgs./ft.$^2$ of silver and about 71 mgs./ft.$^2$ of gelatin;

3. a layer of a 60-30-4-6 copolymer of butylacrylate, diacetone acrylamide, styrene and methacrylic acid and polyacrylamide coated at a coverage of about 175 mgs./ft.$^2$ of the copolymer and about 5 mgs./ft.$^2$ of polyacrylamide;

4. a layer of magenta dye developer dispersed in gelatin and coated at a coverage of about 75 mgs./ft.$^2$ of dye and about 66 mgs./ft.$^2$ of gelatin;

5. a green-sensitive gelatino silver iodochlorobromide emulsion coated at a coverage of about 80 mgs./ft.$^2$ of silver and about 63 mgs./ft.$^2$ of gelatin;

6. a layer containing the copolymer referred to above in layer 3 and polyacrylamide coated at a coverage of about 95 mgs./ft.$^2$ of copolymer and about 12 mgs./ft.$^2$ of polyacrylamide;

7. a layer of yellow dye developer dispersed in gelatin and coated at a coverage of about 83 mgs./ft.$^2$ of dye and about 58 mgs./ft.$^2$ of gelatin;

8. a blue-sensitive gelatino silver iodobromide emulsion layer including the auxiliary developer 4'-methylphenyl hydroquinone coated at a coverage of about 120 mgs./ft.$^2$ of silver, about 52 mgs./ft.$^2$ of gelatin and about 30 mgs./ft.$^2$ of auxiliary developer; and 9. a layer of gelatin coated at a coverage of about 40 mgs./ft.$^2$ of gelatin. The red- and green-sensitive silver iodochlorobromide emulsions (approximately 85 mole percent bromide, 3 mole percent iodide, 12 mole percent chloride) were prepared substantially as described in Example 1; see also FIG. 4. The blue-sensitive silver iodobromide emulsion (approximately 98 mole percent bromide, 2 mole percent iodide) was an emulsion similar to that used in Polaroid SX-70 Land film, the grain size and distribution being illustrated by the electron micrograph reproduced in FIG. 5.

A transparent 4 mil. polyethylene teraphthalate film base was coated, in succession, with the following layers to form an image-receiving component:

1. as a polymeric acid layer, the partially butyl ester of polyethylene/maleic anhydride copolymer at a coverage of about 2,500 mgs./ft.$^2$;

2. a timing layer containing about a 40:1 ratio of a 60-30-4-6 copolymer of butylacrylate, diacetone acrylamide, styrene and methacrylic acid and polyacrylamide at a coverage of about 500 mgs./ft.$^2$; and 3. a polymeric image-receiving layer containing a 2:1 mixture, by weight, of polyvinyl alcohol and poly-4-vinylpyridine, at a coverage of about 300 mgs./ft.$^2$. The two components thus prepared were then taped together, in laminate form, at their respective edges to provide an integral film unit, with a rupturable container retaining an aqueous alkaline processing solution fixedly mounted on the leading edge of each of the components, by pressure-sensitive tapes, so that, upon application of compressive pressure to the container to rupture the container's marginal seal, its contents were distributed in a layer approximately 0.0026 inch thick between the image-receiving layer and the gelatin overcoat layer of the photosensitive component. The aqueous alkaline processing composition comprised:

| | | |
|---|---|---|
| Potassium hydroxide (85%) | 5.0 | 5.0 g. |
| N-benzyl-α-picolinium bromide (50% solution in water) | 1.24 | g. |
| N-phenethyl-α-picolinium bromide | 0.72 | g. |
| Sodium carboxymethyl cellulose (Hercules Type 7H4F providing a viscosity of 3000 cps. at 1% in water at 25°C.) | 1.06 | g. |
| Titanium dioxide | 41.5 | g. |
| 6-methyl uracil | 0.64 | g. |
| bis-(β-aminoethyl)-sulfide | 0.045 | g. |
| Lithium nitrate | 0.1 | g. |
| Benzotriazole | 0.55 | g. |
| 6-methyl-5-bromo-4-azabenzimidazole | 0.03 | g. |
| Colloidal silica aqueous dispersion (30% $SiO_2$) | 1.82 | g. |
| N-2-hydroxyethyl-N,N',N'-tris-carboxymethyl-ethylene diamine | 0.82 | g. |
| Lithium hydroxide | 0.2 | g. |
| 6-benzylamino-purine | 0.39 | g. |
| Polyethylene glycol (molecular weight 6000) | 0.53 | g. |
| Water to make 100 g. | | |

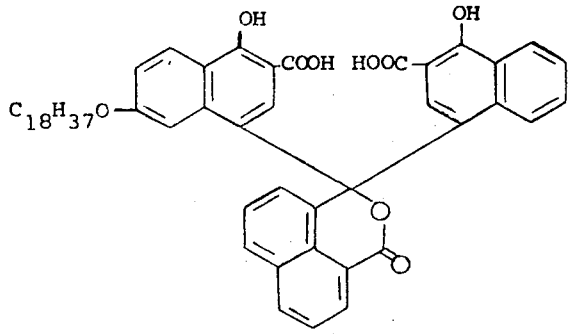

2.68 g.

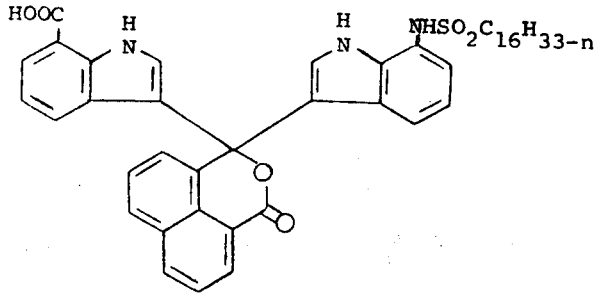

0.6 g.

The photosensitive element was exposed through the transparent support and the layers thereon, the processing composition distributed by passing the film unit between a pair of pressure-applying rolls and into a lighted area. The laminate obtained by distribution of the processing composition was maintained intact to provide a multicolor integral negative-positive reflection print which exhibited good color quality and separation. The neutral density column of the multicolor transfer image exhibited the following reflection densities (measured 6 hours after processing):

| | Red | Green | Blue |
|---|---|---|---|
| $D_{max.}$ | 1.96 | 2.00 | 1.85 |
| $D_{min.}$ | 0.15 | 0.17 | 0.21 |

The characteristic curves of the red, green and blue densities of the neutral column are reproduced in FIG. 1. The transfer image exhibited a markedly extended dynamic range (43 red, 37 green and 27 blue). The transfer image exhibited very good color saturation and color separation with lower contrast than would have been obtained using the same silver iodobromide emulsion in the green- and red-sensitive silver halide emulsion layers as was used in the blue-sensitive silver halide emulsion layer.

EXAMPLE 4

The procedure described in Example 3 was repeated except that the blue-sensitive silver halide emulsion layer also contained the substituted-halide silver iodochlorobromide emulsion (as used in the green- and red-sensitive silver halide emulsion layers), coated at a coverage of about 120 mgs./ft.$^2$ of silver and about 94 mgs./ft.$^2$ of gelatin. The neutral density column exhibited the following reflection densities:

| | Red | Green | Blue |
|---|---|---|---|
| $D_{max.}$ | 1.95 | 1.95 | 1.83 |
| $D_{min.}$ | 0.15 | 0.17 | 0.21 |

The characteristic curves of the red, green and blue components of the neutral density column are reproduced in FIG. 2. The multicolor transfer image obtained in this example also exhibited low contrast, good color saturation and good color isolation. The dynamic range, while extended, was not as large as exhibited by the transfer image of Example 3.

EXAMPLE 5

A multicolor photosensitive element similar to that prepared in Examples 3 and 4 was prepared using the same cyan, magenta and yellow dye developers and a substituted-halide silver iodochlorobromide emulsion (approximately 79 mole percent bromide, 3 mole percent iodide, and 18 mole percent chloride) prepared as described in Example 2.

This photosensitive element was prepared by coating a gelatin-subcoated 4 mil opaque polyethylene terephthalate film base with the following layers:

1. a layer of cyan dye developer dispersed in gelatin and coated at a coverage of about 58 mgs./ft.$^2$ of dye and about 29 mgs./ft.$^2$ of gelatin;
2. a red-sensitive gelatino silver iodochlorobromide emulsion coated at a coverage of about 90 mgs./ft.$^2$ of silver and about 40 mgs./ft.$^2$ of gelatin;
3. a layer of a 60-30-46 copolymer of butylacrylate, diacetone acrylamide, styrene and methacrylic acid and polyacrylamide coated at a coverage of about 194 mgs./ft.$^2$ of the copolymer and about 6 mgs./ft.$^2$ of polyacrylamide;
4. a layer of magenta dye developer dispersed in gelatin and coated at a coverage of about 83 mgs./ft.$^2$ of dye and about 51 mgs./ft.$^2$ of gelatin;
5. a green-sensitive gelatino silver iodochlorobromide emulsion coated at a coverage of about 80 mgs./ft.$^2$ of silver and about 35 mgs./ft.$^2$ of gelatin;
6. a layer containing the copolymer referred to above in layer 3 and polyacrylamide coated at a coverage of about 95 mgs./ft.$^2$ of copolymer and about 12 mgs./ft.$^2$ of polyacrylamide;
7. a layer of yellow dye developer dispersed in gelatin and coated at a coverage of about 103 mgs./ft.$^2$ of dye and about 42 mgs./ft.$^2$ of gelatin;
8. a blue-sensitive gelatino silver iodochlorobromide emulsion layer including the auxiliary developer 4′-methylphenyl hydroquinone coated at a coverage of about 144 mgs./ft.$^2$ of silver, about 63 mgs./ft.$^2$ of gelatin and about 36 mgs./ft.$^2$ of auxiliary developer; and
9. a layer of gelatin coated at a coverage of about 40 mgs./ft.$^2$ of gelatin.

The photosensitive element was exposed and processed in the same manner as described in Example 3, except the concentration in the processing composition of the 6-methyl uracil was 0.64 g. and the concentration of the potassium hydroxide was 4.85 g. The neutral column of resulting multicolor integral negative-positive reflection print exhibited the following densities:

| | Red | Green | Blue |
|---|---|---|---|
| $D_{max.}$ | 2.05 | 2.16 | 2.01 |
| $D_{min.}$ | 0.16 | 0.18 | 0.25 |

As evidenced by the characteristic curves reproduced in FIG. 3 of the red, green and blue density components of the neutral density column, the transfer image was of lower contrast and greater dynamic range (in excess of 70) than the images obtained in either Examples 3 or 4. The toe extant of the characteristic curves, however, was not as long.

As noted above in connection with Examples 3, 4 and 5, use of a predominantly homogeneous grain size substitutedhalide silver halide emulsion has been found to give lower contrast than was obtained with silver halide emulsions of the type represented in FIG. 5, together with comparable color separation and color saturation. Improved temperature latitude was observed, with less change in color balance at higher temperatures. A highly significant increase also was obtained in the dynamic range of the multicolor transfer image, and the resulting extended exposure latitude was readily demonstrated in flash exposures, in that subjects closer to and farther from the camera were well reproduced. The reason or reasons for these highly desirable sensitometric improvements are not understood, but it is clear that they are directly attributable to the use of the predominantly homogeneous substituted-halide silver halide emulsions. It has been demonstrated, for example, that the induction period for the appearance of fog silver is markedly longer, e.g., about three to four times as long, with the substitutedhalide silver halide emulsions than with the single jet emulsions of FIG. 5. This delay in the cccurrence of fog development which would immobilize dye developer that otherwise would transfer is consistent with the observed lower contrast and longer dynamic range.

While the specific examples given above have been directed to the formation of multicolor integral negativepositive reflection prints, it will be understood that the invention is indeed applicable to multicolor diffusion transfer processes in which the transfer image is separated from the developed negative, as in Polaroid Type 108 Land film. The narrow grain size distribution of the predominantly homogeneous substituted-halide silver halide emulsions utilized in the practice of the present invention is visually demonstrated by inspection of the electron micrographs reproduced in FIGS. 4 and 5.

The substituted-halide silver halide emulsions utilized in this invention are used as negative-working emulsions and may be chemically sensitized, optically sensitized, coated, stabilized, etc., in the same manner and with the same reagents and aids as conventional negative working silver halide emulsions, i.e., silver halide emulsions prepared without the halide substitution or metathesis.

Certain similarities will be apparent between the above preparation of the substituted-halide silver halide emulsions and the preparation in U.S. Pat. No. 2,592,250 issued Apr. 8, 1952 to Davey and Knott by "converting" a silver chloride emulsion to a silver halide which is less soluble in water than silver chloride, e.g., a silver iodobromide emulsion. The Davey-Knott emulsions are classically known as "internal latent image emulsions" and primarily have been utilized for their relatively high internal sensitivity and relatively low surface sensitivity, a property rendering them useful in providing direct positive images (a positive working emulsion). Indeed, the use of internal latent image emulsions to form negative, instead of positive, dye developer transfer images is disclosed in U.S. Pat. No. 3,245,789 issued Apr. 12, 1966 to Howard G. Rogers.

It is recognized that it has been proposed, e.g., in U.S. Pat. Nos. 3,697,269 3,697,270 and 3,697,271, all issued Oct. 10, 1972 to William J. Timson, to use a substantially uniform grain size emulsion in dye developer transfer systems. The disclosures of said patents may be readily distinguished, inter alia, by their failure to disclose or suggest the use of substituted-halide silver halide emulsions of any grain size characteristics, by their use of different size grains in each of the silver halide emulsion layers, and by their use of a plurality of widely different uniform grain size emulsions in the same layer. The particular silver halide emulsions disclosed in these patents were made by a procedure which would make the individual grains more alike in size and sensitivity, thereby rendering desirable the use of such mixtures.

Since certain changes may be made in the above product and processes without departing from the scope of the invention herein involved, it is intended that all matter contained in the above description or shown in the accompanying drawings shall be interpreted as illustrative and not in a limiting sense.

What is claimed is:

1. A photographic product comprising a support; a negative-working red-sensitive silver halide emulsion; a negative-working green-sensitive silver halide emulsion; and a negative-working blue-sensitive silver halide emulsion; said silver halide emulsions having associated therewith, respectively, a cyan dye developer, a magenta dye developer and a yellow dye developer; at least two of said silver halide emulsions being predominantly homogeneous substituted-halide silver halide emulsions, the silver halide grains of each said substituted-halide silver halide emulsion having a halide content of 0 to about 10 mole percent iodide and about 1 to 50 mole percent chloride, the remaining halide being bromide, said substituted-halide silver halide grains having been prepared by the replacement of chloride anions of silver chloride or silver iodochloride grains with bromide or bromide and iodide anions, said substituted-halide silver halide grains having a mean diameter within the range of about 0.7 to 1.5 microns, at least 80% of said silver halide grains having a diameter within ± 40% of said mean diameter, each said substituted-halide silver halide emulsion being chemically surface sensitized.

2. A photographic product as defined in claim 1 wherein the core of said substituted-halide silver halide grains contains iodide.

3. A photographic product as defined in claim 1 wherein at least 90% of said substituted-halide silver halide grains have a diameter within ± 30% of said mean diameter.

4. A photographic product as defined in claim 1 wherein said mean diameter is about 0.9 micron.

5. A photographic product as defined in claim 1 wherein said mean diameter is about 1.0 micron.

6. A photographic product as defined in claim 1 wherein said mean diameter is about 1.2 microns.

7. A photographic product as defined in claim 1 wherein each of said silver halide emulsions is a substituted-halide silver halide emulsion.

8. A photographic product as defined in claim 1 wherein each said substituted-halide silver halide emulsion contains at least 1 mole percent iodide.

9. A photographic product as defined in claim 1 wherein said substituted-halide silver halide emulsions each have the same mean grain diameter and grain size distribution.

10. A photographic product as defined in claim 1 wherein each of said red-, green- and blue-sensitive silver halide emulsions is a predominantly homogeneous substituted-halide silver halide emulsion.

11. A photographic product as defined in claim 10 wherein the mean silver halide grain diameter of each of said substituted-halide silver halide emulsions is about 0.9 micron.

12. A photographic product as defined in claim 10 wherein the mean silver halide grain diameter of each of said substituted-halide silver halide emulsions is about 1.2 microns.

13. A photographic product as defined in claim 8 wherein said substituted-halide silver halide emulsion is a silver iodochlorobromide emulsion containing more than about 10 mole percent chloride.

14. A photographic product as defined in claim 1 including an image-receiving layer for receiving a dye developer diffusion transfer image.

15. A photographic product as defined in claim 1 wherein each of said silver halide emulsion layers containing a substituted-halide silver halide emulsion is substantially free of overlapping silver halide grains.

16. A photographic product comprising a first support; a negative-working red-sensitive silver halide emulsion; a negative-working green-sensitive silver halide emulsion; and a negative-working blue-sensitive silver halide emulsion; said silver halide emulsions having associated therewith, respectively, a cyan dye developer, a magenta dye developer and a yellow dye developer; an image-receiving layer for receiving image dyes transferred thereto by diffusion as a function of exposure and development of said silver halide emulsion layers; a second support which is transparent and through which said image-receiving layer may be viewed; a rupturable container releasably holding a processing composition adapted, upon distribution between predetermined layers of said film to develop said silver halide emulsions and to effect the formation of a transfer image in dye in said image-receiving layer, said processing composition also being adapted to provide a permanent laminate including said developed silver halide emulsions and said image-receiving layer; and means providing a light-receiving layer between said image-receiving layer and said silver halide emulsions effective to provide a white background for viewing said transfer image and for masking said developed silver halide emulsions; at least two of said silver halide emulsions being predominantly homogeneous substituted-halide silver halide emulsions, the silver halide grains of each said substituted-halide silver halide emulsion having a halide content of 0 to about 10 mole percent iodide and about 1 to 50 mole percent chloride, the remaining halide being bromide, said substituted-halide silver halide grains having been prepared by the replacement of chloride anions of silver chloride or silver iodochloride grains with bromide or bromide and iodide anions, said substituted-halide silver halide grains having a mean diameter within the range of about 0.7 to 1.5 microns, at least 80% of said silver halide grains having a diameter within ± 40% of said mean diameter, said substituted-halide silver halide emulsions being chemically surface sensitized.

17. A photographic product as defined in claim 16 wherein said means for providing a light-reflecting layer comprises a preformed layer of a white pigment.

18. A photographic product as defined in claim 16 wherein said means for providing a light-reflecting layer comprises a white pigment dispersed in said processing composition.

19. A photographic product as defined in claim 16 wherein said first support is opaque.

20. A photographic product as defined in claim 16 wherein said transparent support is a polyester.

21. A photographic product as defined in claim 16 wherein said transparent support and said image-receiving layer comprise a separate element adapted to be brought into superposed relationship with said silver halide emulsions.

22. A photographic product as defined in claim 16 wherein said layers are held in fixed relationship between said supports prior to and during exposure.

23. A photographic product as defined in claim 22 wherein said fixed relationship is provided by tape means along at least two parallel sides of said product.

24. A photographic product as defined in claim 22 wherein said product is a laminate of said layers between said first and said second supports, the bond between a pair of predetermined layers being weaker than the bonds between the other layers, said rupturable container being so positioned as to release said processing composition for distribution between said pair of layers.

25. A photographic product as defined in claim 16 wherein said blue-sensitive silver halide emulsion layer is between said image-receiving layer and said other silver halide emulsion layers.

26. A photographic product as defined in claim 16 wherein said blue-sensitive silver halide emulsion layer is between said first support and said other silver halide emulsion layers, and said first support is transparent.

27. A photographic product as defined in claim 16 including means to reduce the pH of a layer of said processing composition from a first pH to a second pH.

28. A photographic product as defined in claim 27 wherein said means to reduce the pH comprises a layer of an acid-reacting reagent positioned between said transparent support and said image-receiving layer.

29. A photographic product as defined in claim 28 wherein said acid-reacting reagent is a polymer.

30. A photographic product as defined in claim 16 wherein said processing composition includes an optical filter agent which is colored at the pH of said processing composition, said optical filter agent being adapted to be rendered colorless by reducing said pH.

31. A photographic product as defined in claim 16 wherein the core of said substituted-halide silver halide grains contains iodide.

32. A photographic product as defined in claim 16 wherein at least 90% of said substituted-halide silver halide grains have a diameter within ± 30% of said mean diameter.

33. A photographic product as defined in claim 16 wherein said mean diameter is about 0.9 micron.

34. A photographic product as defined in claim 16 wherein said mean diameter is about 1.2 microns.

35. A photographic product as defined in claim 16 wherein each said substituted-halide silver halide emulsion contains at least 1 mole percent iodide.

36. A photographic product as defined in claim 16 wherein each of said red-, green- and blue-sensitive silver halide emulsions is a predominantly homogeneous substituted-halide silver halide emulsion.

37. A photographic product as defined in claim 36 wherein the mean silver halide grain diameter of each of said substituted-halide silver halide emulsions is about 0.9 micron.

38. A photographic product as defined in claim 16 wherein the mean silver halide grain diameter of each of said substituted-halide silver halide emulsions is about 0.9 micron.

39. A photographic product as defined in claim 16 wherein the mean silver halide grain diameter of each of said substituted-halide silver halide emulsions is about 1.2 microns.

40. A method of forming a diffusion transfer multicolor dye image comprising developing an exposed photosensitive element comprising a negative-working red-sensitive silver halide emulsion, a negative-working green-sensitive silver halide emulsion and a negative-working blue-sensitive silver halide emulsion, said silver halide emulsions having associated therewith, respectively, a cyan dye developer, a magenta dye developer and a yellow dye developer, forming an imagewise distribution of diffusible dye developers as a function of said development, and transferring at least a portion of said imagewise distribution of diffusible dye developers to an image-receiving layer in superposed relationship with said silver halide emulsions to provide said multicolor dye image, at least two of said silver halide emulsions being predominantly homogeneous substituted-halide silver halide emulsions, the silver halide grains of each said substituted-halide silver halide emulsion having a halide content of 0 to about 10 mole percent iodide and about 1 to 50 mole percent chloride, the remaining halide being bromide, said substituted-halide silver halide grains having been prepared by the replacement of chloride anions of silver chloride or silver iodochloride grains with bromide or bromide and iodide anions, said substituted-halide silver halide grains having a mean diameter within the range of about 0.7 to 1.5 microns, at least 80% of said silver halide grains having a diameter within ± 40% of said mean diameter, said substituted-halide silver halide emulsions being chemically surface sensitized.

41. The method as defined in claim 40 wherein said mean diameter is about 0.9 micron.

42. The method as defined in claim 40 wherein said mean diameter is about 1.2 microns.

43. The method as defined in claim 40 wherein each of said red-, green- and blue-sensitive silver halide emulsions is a substituted-halide silver halide emulsion.

44. The method as defined in claim 40 wherein each said substituted-halide silver halide emulsion contains at least 1 mole percent iodide.

45. The method as defined in claim 40 wherein each said substituted-halide silver halide emulsion is a silver iodochlorobromide emulsion containing more than about 10 mole percent chloride.

* * * * *